US010966026B2

(12) United States Patent
Liu et al.

(10) Patent No.: US 10,966,026 B2
(45) Date of Patent: Mar. 30, 2021

(54) METHOD AND APPARATUS FOR PROCESSING AUDIO DATA IN SOUND FIELD

(71) Applicant: SHENZHEN SKYWORTH-RGB ELECTRONIC CO., LTD., Guangdong (CN)

(72) Inventors: Ying Liu, Guangdong (CN); Dongyan Zheng, Guangdong (CN); Yongqiang He, Guangdong (CN)

(73) Assignee: SHENZHEN SKYWORTH-RGB ELECTRONIC CO., LTD., Guangdong (CN)

( * ) Notice: Subject to any disclaimer, the term of this patent is extended or adjusted under 35 U.S.C. 154(b) by 0 days.

(21) Appl. No.: 16/349,403

(22) PCT Filed: Feb. 13, 2018

(86) PCT No.: PCT/CN2018/076623
§ 371 (c)(1),
(2) Date: May 13, 2019

(87) PCT Pub. No.: WO2018/196469
PCT Pub. Date: Nov. 1, 2018

(65) Prior Publication Data

US 2019/0268697 A1 Aug. 29, 2019

(30) Foreign Application Priority Data

Apr. 26, 2017 (CN) ..... 201710283767.3

(51) Int. Cl.
*H04R 5/02* (2006.01)
*H04R 5/033* (2006.01)
(Continued)

(52) U.S. Cl.
CPC ..... *H04R 5/02* (2013.01); *H04R 5/033* (2013.01); *H04S 3/008* (2013.01); *H04S 7/303* (2013.01);
(Continued)

(58) Field of Classification Search
None
See application file for complete search history.

(56) References Cited

U.S. PATENT DOCUMENTS 9,491,560 B2 11/2016 Adams
2009/0041254 A1 2/2009 Jin et al.
(Continued)

FOREIGN PATENT DOCUMENTS

CN 101819774 A 9/2010
CN 104991573 A 10/2015
(Continued)

OTHER PUBLICATIONS

International Search Report issued in connection with corresponding International Patent Application No. PCT/CN2018/076623, 2 pages, dated May 4, 2018.
(Continued)

*Primary Examiner* — Kenny H Truong
(74) *Attorney, Agent, or Firm* — Duane Morris LLP

(57) ABSTRACT

Provided are a method and an apparatus for processing audio data in a sound field. The method includes: acquiring the audio data in the sound field; processing the audio data through a preset restoration algorithm to extract audio data information about the sound field carried by the audio data; acquiring motion information about a target, and generating, through a preset processing algorithm, target-based sound field audio data based on the audio data information and the motion information about the target.

5 Claims, 4 Drawing Sheets

(51) Int. Cl.
*H04S 7/00* (2006.01)
*H04S 3/00* (2006.01)

(52) U.S. Cl.
CPC ..... *H04S 7/304* (2013.01); *H04S 2400/11* (2013.01); *H04S 2400/15* (2013.01); *H04S 2420/01* (2013.01)

(56) References Cited

U.S. PATENT DOCUMENTS

| | | | | |
|---|---|---|---|---|
| 2013/0041648 | A1 | 2/2013 | Osman | |
| 2015/0010169 | A1* | 1/2015 | Popova | H04S 7/303 381/107 |
| 2015/0373477 | A1* | 12/2015 | Norris | H04R 5/04 381/303 |
| 2016/0080884 | A1* | 3/2016 | Song | G10L 19/008 381/17 |
| 2016/0183024 | A1* | 6/2016 | Karkkainen | H04S 7/303 381/17 |
| 2016/0241980 | A1 | 8/2016 | Najaf-Zadeh et al. | |
| 2019/0335288 | A1* | 10/2019 | Latypov | H04S 3/008 |

FOREIGN PATENT DOCUMENTS

| | | | | |
|---|---|---|---|---|
| CN | 105451152 | A | | 3/2016 |
| CN | 106154231 | | | 11/2016 |
| CN | 106154231 | A | * | 11/2016 |
| CN | 106993249 | A | | 7/2017 |
| EP | 2700907 | | | 2/2014 |

OTHER PUBLICATIONS

Extended European Search Report dated Dec. 11, 2020 in Corresponding European Patent Application No. 18790681.3.

* cited by examiner

METHOD AND APPARATUS FOR PROCESSING AUDIO DATA IN SOUND FIELD

CROSS REFERENCE TO RELATED APPLICATIONS

This is a National Stage Application, filed under 35 U.S.C. 371, of International Patent Application No. PCT/CN2018/076623, filed on Feb. 13, 2018, which claims priority to Chinese patent application No. 201710283767.3 filed on Apr. 26, 2017, contents of both of which are incorporated herein by reference in their entireties.

TECHNICAL FIELD

The present disclosure relates to virtual reality (VR) technology and, in particular, to a method and an apparatus for processing audio data in a sound field.

BACKGROUND

With a continuous development of science and technology, the virtual reality technology is gradually applied to lives of users. The virtual reality means creating a virtual three dimensional (3D) world through computer simulation to provide a user with sensory experience of sight, hearing and touch, so that the user may observe an object in the 3D space timely without any restriction.

In the related virtual reality technology, the virtual reality of sound (to create a surround stereophonic effect) is generally implemented via a multi-channel stereo audio equipment or a multi-channel stereophone. However, most surround stereophonic effect substantially is an effect in the two dimensional (2D) level. That is, through this effect, it can only roughly simulate whether a sound source is on the left side or the right side of the user, or whether the sound source is far away from or near the user. As a result, in a process of scene simulation, the sound only has a simple auxiliary effect and cannot satisfy requirements of the user for obtaining "immersive" experience in the current scene.

Therefore, the current virtual reality technology of the sound has poor reliability and user experience needs to be improved.

SUMMARY

The present disclosure provides a method and an apparatus for processing audio data in a sound field such that the audio data received by a user changes with the motion of the user. In terms of hearing, the sound effect in a scene may be accurately presented to the user, thereby improving the user experience.

The present disclosure provides a method for processing audio data in a sound field. The method includes:

acquiring the audio data in the sound field;

processing the audio data through a preset restoration algorithm to extract audio data information about the sound field carried by the audio data;

acquiring motion information about a target; and generating, through a preset processing algorithm, target-based sound field audio data based on the audio data information and the motion information about the target The present disclosure provides an apparatus for processing audio data in a sound field. The device includes:

an original sound field acquisition module configured to acquire the audio data in the sound field;

an original sound field restoration module configured to process the audio data through a preset restoration algorithm to extract audio data information about the sound field carried by the audio data;

a motion information acquisition module configured to acquire motion information about a target; and a target audio data processing module configured to generate, through a preset processing algorithm, target-based sound field audio data based on the audio data information and the motion information about the target.

The present disclosure provides a computer-readable storage medium for storing computer-executable instructions. The computer-executable instructions are used for executing any method described above.

The present disclosure provides a terminal device. The terminal device includes one or more processors, a memory and one or more programs. When executed by the one or more processors, the one or more programs, which are stored in the memory, execute any method described above.

The present disclosure provides a computer program product. The computer program product includes a computer program stored on a non-transient computer-readable storage medium, where the computer program includes program instructions that, when executed by a computer, enable the computer to execute any method described above.

In the technical solution of the present disclosure, target-based sound field audio data may be obtained, and the sound field may be reconstructed according to the real-time motion of a target, so that the audio data in the sound field changes with the motion of the target. In the process of scene simulation, the auxiliary effect of the sound may be enhanced and "immersive" experience of the user in the current scene may be improved.

BRIEF DESCRIPTION OF DRAWINGS

The drawings used in the description of embodiments of the present disclosure will be described below.

DETAILED DESCRIPTION

Technical solutions of the present disclosure will be described below with reference to the drawings.

Figure 1:
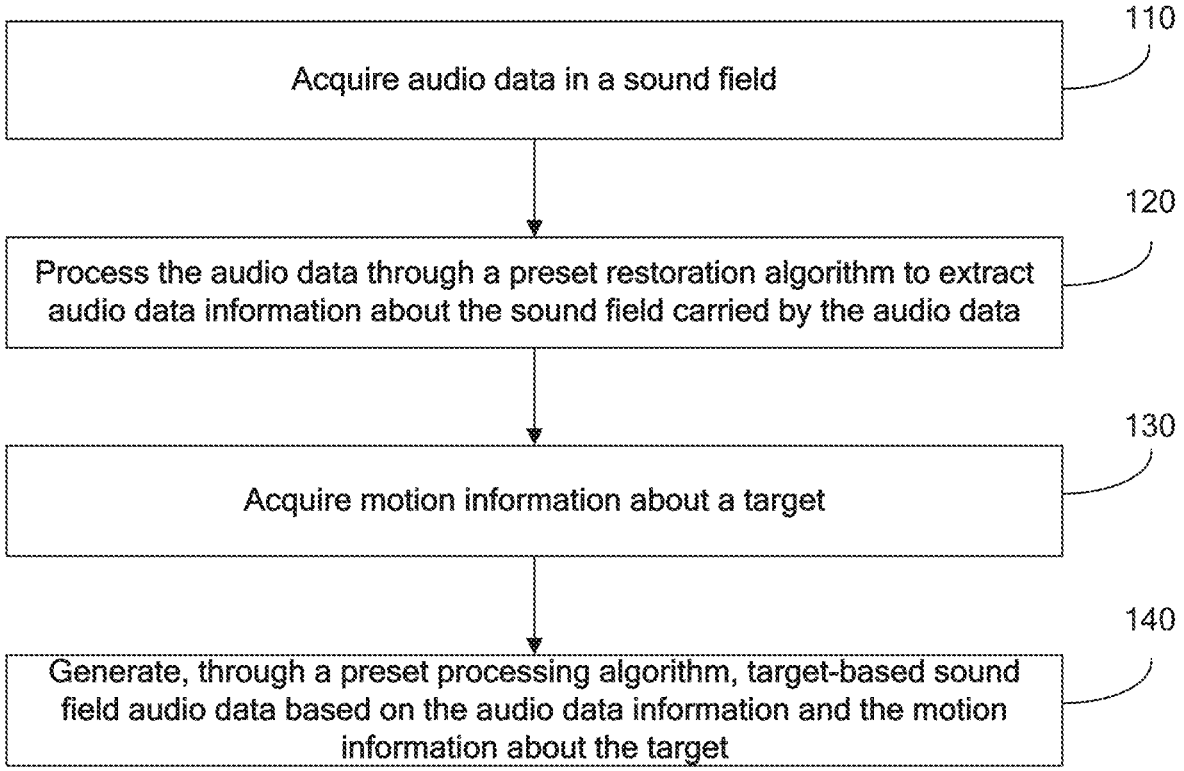
FIG. 1 is a flowchart showing a method for processing audio data in a sound field according to an embodiment of the present disclosure.

FIG. 1 is a flowchart showing a method for processing audio data in a sound field according to an embodiment of the present disclosure. The method of this embodiment may be executed by a virtual reality (VR) apparatus or system such as a virtual reality helmet, glasses or a head-mounted display, and may be implemented by software and/or hardware disposed in the virtual reality apparatus or system.

As shown in FIG. 1, the method includes steps described below.

In step 110, audio data in a sound field is acquired.

A device used for acquiring the audio data in the sound field may be hardware and/or software integrated with a professional audio data production and/or processing software or engine. The audio data in the sound field may be pre-produced original audio data matched with a video such as a movie and a game. Optionally, the audio data includes information about the position or direction of a sound source in a scene corresponding to the audio. Information related to the sound source may be obtained through analyzing the audio data.

Exemplarily, in a lab or research and development environment, an atmos production software may be used as a tool to restore basic audio data. Before using the atmos production software, an atmos production engine needs to be created and initialized (for example, setting an initial distance between a sound source and a user).

Exemplarily, an example of processing audio data in a sound field, which is matched with a VR game, is described below.

Unity3D developed by Unity Technologies may be used as an atmos software to process the audio data in the sound field of the game. The unity3D is a multi-platform integrated game development tool to create interactive content such as 3D video games, architectural visualization and real-time 3D animation, i.e., it is a fully integrated professional game engine. During the experiment, a game atmos engine package is imported into a unity3D project; the following menu is selected in the Unity3D: Edit\Project settings\Audio\Spatializer Plugin\; the atmos engine package imported is selected; an 'AudioSource' widget as well as an atmos script is added to a sound object required to be added atmos, and finally atmos is directly set in Unity Edit. An atmos processing mode is opened by selecting "Enable Spatialization".

After the above preparation work is completed, audio data in the sound field in a multimedia file corresponding to the atmos engine package may be automatically obtained.

Exemplarily, if information about the position of the sound source is not carried in the audio data or the information about the position of the sound source carried in the audio data cannot be recognized by a conventional audio data processing software, information about an initial position of the sound source may be obtained by manually inputting parameter information about the position of the sound source.

There may be one sound source or multiple sound sources in the sound field. In the case that there are multiple sound sources, one sound source is selected according to characteristics of the audio data played by the sound source when information about the position of the sound sources is acquired. For example, if a scene in the current game is a war scene, the sound of a gunshot or cannon which is higher than a certain threshold may be taken as a target audio for representing the current scene, and the information about the position of the sound source which plays the target audio is acquired. The advantage of such setting is that audio information which is representative for audio rendering on the current scene may be captured, thereby enhancing rendering effect on the current scene and improving game experience of the user.

In step 120, the audio data is processed through a preset restoration algorithm to extract audio data information about the sound field carried by the audio data.

Optionally, the audio data information about the sound field includes at least one of the following information: position information, direction information, distance information and motion trajectory information about a sound source in the sound field.

Instead of using the preset restoration algorithm, a professional audio data compilation/de-compilation tool such as Unity3D and WavePurity may also be used to extract original audio data information. The preset restoration algorithm may be an algorithm integrated in the professional audio data compilation/de-compilation tool such as Unity3D and WavePurity to extract the original audio data information. Exemplarily, the audio data in the sound field among a multimedia file is reversed through the Unity3D software to obtain audio data parameters about the audio such as sampling rate, sampling precision, a total number of channels, bit rate and encoding algorithm, which are used to process the audio data subsequently.

Optionally, the sound source may be split into horizontal position information and vertical position information when the audio data information about the sound field is extracted from the audio data through the preset restoration algorithm. Information about the initial position of the sound source may be analyzed by the virtual reality device through a position analysis method. Since the sound source may be a moving object whose position is not fixed, position information about the sound source at different moments may be obtained. Based on the information about the initial position of the sound source and the information about the position of the sound source at different moments, the following information may be obtained: motion direction information, motion trajectory information about the sound source, information about the distance between the same sound source at different moments and information about the distance between different sound sources at the same time and the like.

Exemplarily, the audio data in the sound field may also be restored according to functional attribute of the audio data when the audio data in the sound field is restored. The functional attribute may include information about volume, tone, loudness or timbre corresponding to current scene. Through selecting the functional attribute of the audio data, the audio data matched with the current scene is restored, and some noises in the scene is eliminated, thereby improving "immersive" experience of the user in the current scene.

In step 130, motion information about a target is acquired.

Exemplarily, different from a conventional scene in which a movie pre-produced in a theater mode is watched at a fixed position in the theater, in a virtual reality experience environment such as the virtual reality game, an experience position of the user, which is fixed in the theater, changes with the scene in the virtual space when a game character is controlled by the user to move in the virtual reality space. In order to let the user experience 3D sound effect in real time in the virtual motion environment, it is especially important to obtain the motion information of the user in real time, thereby indirectly obtaining the position, direction and other parameters of the user in the virtual reality environment and adding the motion information parameters of the user in real time when the conventional pre-produced audio data is processed.

The target mentioned in this step may be the head of the user.

Optionally, motion information about the user's head includes any direction in which the user's head may move and the position of the user's head, for example, may include at least one of: orientation change information, position change information and angle change information. The motion information may be acquired by a three-axis gyroscope integrated in the virtual reality device such as the virtual reality helmet. The determination of the above-mentioned motion information may provide a data basis for the processing of the audio data in the sound field corresponding to the target at different positions, instead of merely positioning the target in four directions of up, down, left and right. Therefore, the atmos engine may adjust the sound field in real time by acquiring the motion information about the target in real time so as to improve the user experience.

In step 140, target-based sound field audio data is generated based on the audio data information and the motion information about the target through a preset processing algorithm.

The target-based sound field audio data refers to the audio data in the sound field, which is received by the target (e.g., the user) in real time through a playback device such as a headset as the user moves. As for the atmos engine in the playback device, information about the position, angle or orientation of the target and the like as well as the audio data information obtained through the preset restoration algorithm may be used as input parameters. After the above-mentioned parameters are processed through the preset processing algorithm, the position, direction or motion trajectory of the sound source may be adjusted accordingly in the virtual scene to follow the target. Therefore, the audio data processed through the preset restoration algorithm may be used as original audio data in the original sound field, and the target-based sound field audio data obtained through the preset processing algorithm may be used as target audio data output to the user.

Exemplarily, if there are multiple sound sources located at different orientations of the user, the user can recognize which sound source plays that voice by tracking the motion of the user in cooperation with the preset processing algorithm. For example, in the case that a detonation happens in front of a character in current real-time game and another detonation happens behind the character, a game player may only hear two detonations from the same direction, one of which is big and another is small, if a conventional method for simulating the sound field is adopted. However, if the method for processing audio data in the sound field provided in this embodiment is adopted, the game player may clearly feel that one detonation happened in front of him and another detonation happened behind him. If a game character controlled by another game player happens to be behind locations where the above two detonations happened, this game player may hear two explosion sounds in front of him if the method for processing audio data in the sound field provided in this embodiment is adopted. Therefore, the method for processing audio data in the sound field provided in this embodiment provides specific direction information for simulating the sound field, thereby improving the "immersive" experience of the user in the scene.

Optionally, the preset processing algorithm is a head related transfer function (Hrtf) algorithm. The Hrtf algorithm is a processing technology for sound localization which transfers the sound to an ambisonic domain and then converts the sound by using a rotation matrix. The process of the Hrtf algorithm is as follows: converting the audio into a B-format signal; converting the B-format signal into a virtual speaker array signal, and then filtering the virtual speaker array signal through a HRTF filter to obtain virtual surround sound. In conclusion, through the algorithm, not only the target-based audio data is obtained, but also the original audio is effectively simulated, so that the audio played to the user is more verisimilar. For example, if there are multiple sound sources in a VR game, the multiple sound sources may be processed separately through the Hrtf algorithm, so that the game player may better immerse into the virtual game.

This embodiment provides a method for processing audio data in the sound field. In this method, after the audio data in the original sound field and the information about the position of the sound source for the audio data are obtained, the original sound field is restored based on the audio data and the information about the position of the sound source through the preset restoration algorithm to obtain basic parameter information of the audio data in the original sound field. In addition, the motion information such as orientation, position, angle and the like of a moving target such as a user is acquired in real time, and the audio data sound field based on the moving target is obtained based on the audio data information and the motion information about the moving target through the preset audio processing algorithm. The sound field audio data of the target is reconstructed based on the real-time motion of the target and the audio data basic information such as the number of sound sources, the tone, the loudness, the sampling rate and the number of channels restored from the audio data in the original sound field to obtain real-time sound field audio data based on the moving target, so that the reconstructed audio data in the sound field changes in real time with the real-time motion of the target. Therefore, in the process of scene simulation, the sound may be enhanced, and the "immersive" experience of the user in the current scene is improved.

Figure 2:
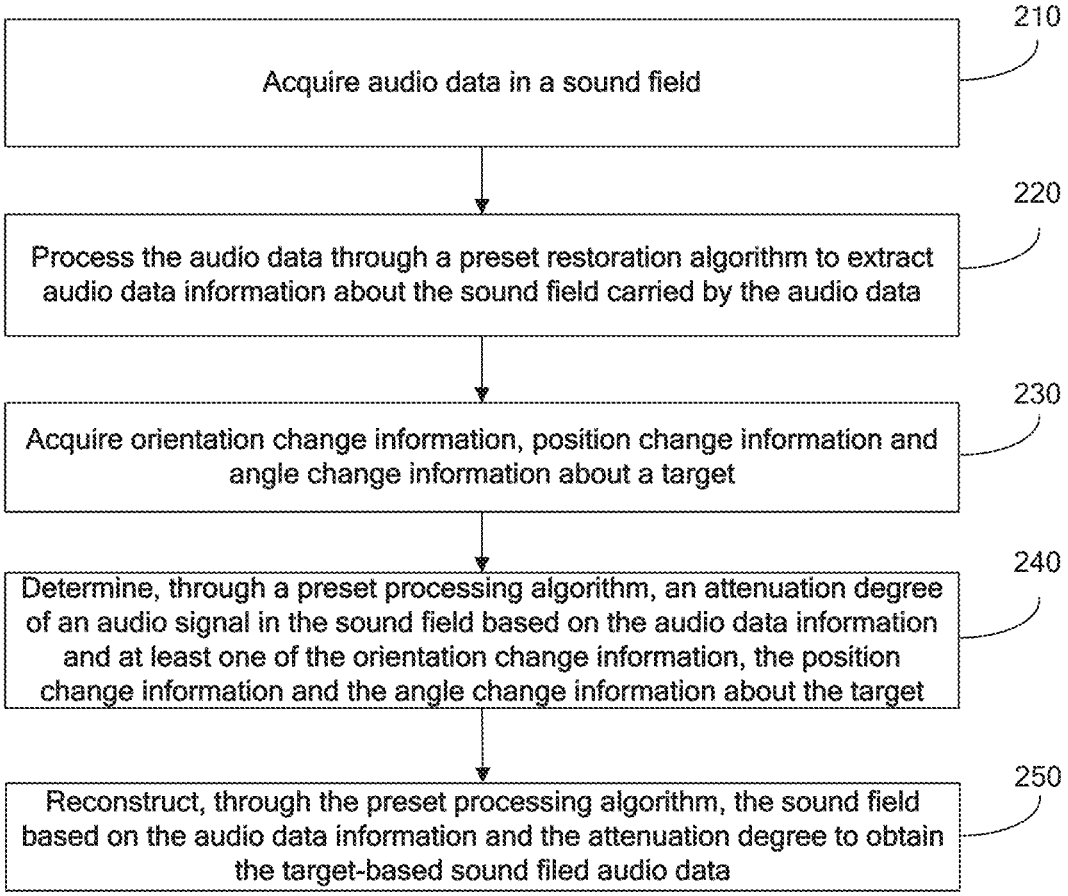
FIG. 2 is a flowchart showing a method for processing audio data in a sound field according to an embodiment of the present disclosure.

FIG. 2 is a flowchart showing a method for processing audio data in a sound field according to an embodiment of the present disclosure. As shown in FIG. 2, the method for processing the audio data in the sound field provided by the present embodiment includes steps described below.

In step 210, audio data in a sound field is acquired.

In step 220, the audio data is processed through a preset restoration algorithm to extract audio data information about the sound field carried by the audio data.

In an original sound field, audio data in the original sound field may be obtained. Further, through the preset restoration algorithm, information about initial position and initial angle of the sound source at the initial time may be analyzed from the audio data and used as initial information about the sound source in the original sound field. Since the initial information about the sound source at different moments is different, the initial information about the sound source may provide a data basis for the audio data processing in the next step.

In step 230, orientation change information, position change information and angle change information about a target are acquired.

A three-dimensional coordinate system with X-axis, Y-axis and Z-axis is established by a three axes gyro sensor. Since the Z-axis is added on the basis of the related art, information about different directions, different angles and different orientations of the user is acquired.

In step 240, an attenuation degree of an audio signal in the sound field is determined, through a preset processing algorithm, based on the audio data information and at least one of the orientation change information, the position change information and the angle change information about the target.

Exemplarily, as the position of the user changes, the distance between the user's head/ears and the sound source in the original sound field changes accordingly. Therefore, initial position information and initial angle information about the head and ears of the user before moving as well as initial position information and initial angle information about the sound source in the sound field are respectively acquired. An initial relative distance between the sound source and the user's head/ears before the user moves is calculated. Exemplarily, user head information (including position information and angle information) is acquired at an interval of 10 seconds, that is, information about the position of the user's head, the position of the user's ears, and a rotation angle of the user's head is acquired every 10 seconds. The position information and angle information acquired 10 seconds before are used as the basis of the information processing in the next 10 seconds, and so on.

Exemplarily, step 240 may include: determining an initial distance between the target and the sound source in the sound field; determining relative position information, that is, information about the position of the moved target relative to the sound source, according to at least one of the orientation change information, the position change information and the angle change information about the target; and determining the attenuation degree of the audio signal according to the initial distance and the relative position information.

For different sound fields, the number of sound sources is different and the positions of the sound sources are not fixed. The case where a single sound source is adopted and the case where multiple sound sources are adopted are described below respectively.

1. The Case where Only One Fixed Sound Source Exists in the Sound Field

Before the user's head moves, an initial distance between the user's head (or ears) and the fixed sound source is acquired via a sensor such as a gyroscope in a helmet or other range finders. The position of the user's head before the user moves is set as a coordinate origin (0, 0, 0), and the initial coordinate ($X_0$, $Y_0$, $Z_0$) of the sound source is determined based on the initial distance.

When the sensor detects that the user looks up or looks down, the position of the user's head in the Z-axis direction will change $Z_1$ relative to $Z_0$. If $Z_1>0$, it indicates that the user looks up. In this case, audio signals output by the sound source in the left channel and the right channel are weakened. If $Z_1<0$, it indicates that the user looks down. In this case, audio signals output by the sound source in the left channel and the right channel are enhanced. Assuming that an elevation angle of the user's head corresponding to the lowest audio signal is 45 degrees. If the elevation angle exceeds 45 degrees, the audio signal output remains in the same state as that at the 45 degree elevation angle. Accordingly, assuming that a depression angle of the user's head corresponding to the highest audio signal is 30 degrees. If the depression angle is greater than 30 degrees, the audio signal output remains in the same state as that at the 30 degree depression angle.

Figure 3:
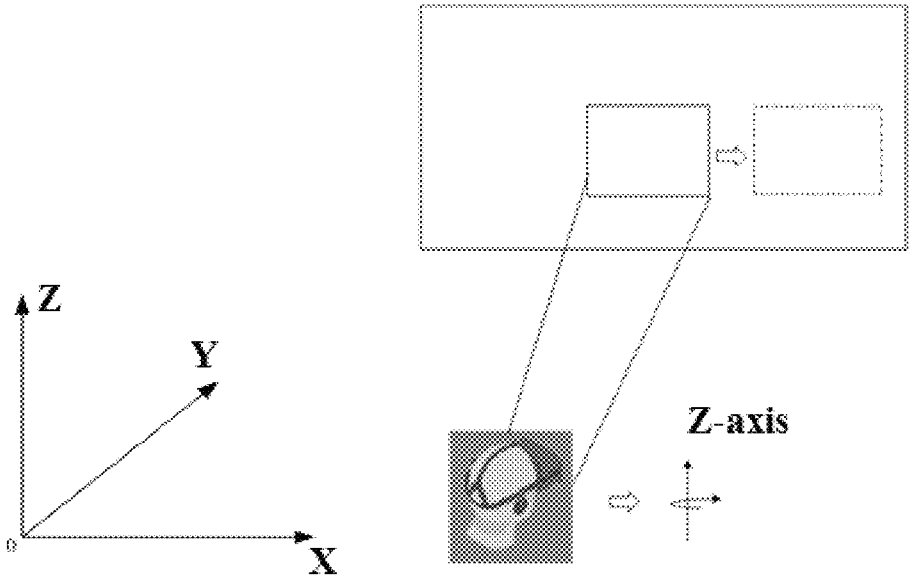
FIG. 3 is a schematic diagram showing changes of a coordinate position of a single sound source according to an embodiment of the present disclosure.

FIG. 3 is a schematic diagram showing coordinate position changes of a single sound source according to an embodiment of the present disclosure. The direction of X-axis, Y-axis and Z-axis is as shown in FIG. 3. When the sensor detects that the user turns his head to the right side or left side, the position of the user's head in the X-axis direction will change $X_1$ relative to $X_0$. As shown in FIG. 3, if $X_1>0$, the Z-axis rotates towards the positive direction of the X-axis, which indicates that the user turns his head to the right side. In this case, the audio signal of the sound source output from left channel is weakened while the audio signal of the sound source output from right channel is enhanced. When the user turns his head to the right side for 90 degrees, the audio signal output from the right channel reaches the maximum while the audio signal output from the left channel reaches the minimum. If $X_1<0$, it indicates that the user turns his head to the left side. In this case, the audio signal output from the left channel is enhanced while the audio signal output from the right channel is weakened. When the user turns his head to the left side for 90 degrees, the audio signal output from the left channel reaches the maximum while the audio signal output from the right channel reaches the minimum. When the user turns his head and body for 180 degrees, the states of the audio signals output from the left channel and the right channel are opposite to the states of the audio signals output from the left channel and the right channel when the user has not turned his head. When the user turns his head and body for 360 degrees, the states of the audio signals output from the left channel and the right channel are the same as the states of the audio signals output from the left channel and the right channel when the user has not turned his head.

When the sensor detects that the user approaches the sound source or is away from the sound source (the position of the sound source remains fixed), the position of the user's head in the Y-axis direction will change $Y_1$ relative to the position of the sound source $Y_0$. When $Y_1<0$, it indicates that the user is away from the sound source. In this case, the audio signals output from the left channel and the right channel are weakened. When $Y_1>0$, it indicates that the user approaches the sound source. In this case, the audio signals output from the left channel and the right channel are enhanced.

2. The Case where Multiple Sound Sources Exist in the Sound Field

For the case where multiple sound sources exist in the sound field, each sound source is processed separately. If the position of each of the multiple sound sources is fixed, as for each sound source, the attenuation degree of the audio signal of the sound source is determined in the same manner as that adopted in the above case 1 where only one fixed sound source exists, which is shown in case 1.

If the position of each of the multiple sound sources is not fixed, the distance between each of the multiple sound sources and the user's head is not fixed. In this case, the position of the user's head before the user moves his head is taken as the coordinate origin (0, 0, 0). At different moments, corresponding coordinate information ($X_n$, $Y_n$, $Z_n$) of each of the multiple sound sources is determined, and the coordinate information at each moment is used as the basis for determining the coordinate information at the next moment. The initial coordinate information of each sound source is set to be ($X_0$, $Y_0$, $Z_0$). At a certain moment, when the user looks up or down (the coordinate on the Z-axis is changed), the user turns his head to the left or right side (the coordinate on the X-axis is changed) or the user moves forward or backward (the coordinate on the Y-axis is changed), the attenuation degree of the audio signal is determined in the same manner as that adopted in the case where the fixed sound source exists (the above case 1), which is shown in the above case 1. After the attenuation degree of the audio signal of each sound source is calculated, audio signals output from different sound sources are adjusted and all audio signals adjusted are superimposed and processed so that the sound heard by the user changes with the motion of the user accordingly.

Optionally, in the case where the position of the sound source is fixed, the attenuation degree of the audio signal has a linear relationship with the initial distance between the target and the sound source. That is, the farther the initial distance between the target and the sound source is, the bigger the attenuation degree of the audio signal is.

In conclusion, after the initial distance between the target (such as the user's head or the user's eyes) and each of the multiple sound sources is determined and the motion information about the target is obtained, the attenuation degree of the audio signal to be output from each of the multiple sound sources is determined. The audio signal in the sound field is updated in real time with the motion of the user by adjusting the audio signal output from each of the multiple sound sources based on the attenuation degree determined, thereby improving the user's hearing experience.

Optionally, the sensor in the user's helmet or glasses may track the user's face in real time and calculate the coordinate of the user's visual focus. When the visual focus coincides with a sound source object, the output of the audio signal is increased to enhance the output effect of the audio signal. The time for adjusting the audio signal may be limited within 20 ms, and the minimum frame rate is set as 60 Hz. Through such setting, the user will hardly feel the delay and jam of the sound feedback, thereby improving the user experience.

In step 250, the sound field is reconstructed based on the audio data information and the attenuation degree through a preset processing algorithm so as to obtain target-based sound filed audio data.

Exemplarily, step 250 includes: adjusting amplitude of the audio signal based on the attenuation degree and taking the audio signal being adjusted as a target audio signal; and reconstructing the sound field based on the target audio signal through the preset processing algorithm to obtain the target-based sound filed audio data.

Exemplarily, in the case that the user is watching a movie, the intensity of the sound received by the user is also reduced (the audio signals output from the left and right channels are reduced) if the user turns his head for 180 degrees (at this time the user faces away from the sound source) relative to the initial position (where the user faces the sound source). At this time, the volume of a headset or a sound box is lowered by reducing the amplitude of the audio signal. Then, the sound field is reconstructed based on the audio signal the amplitude of which is reduced through the Hrtf algorithm, so that the user feels that the sound is transferred from the behind. The advantage of such setting is that the user may experience the change of the sound field brought about by the change of his position, thereby enhancing the user's hearing experience.

In the above embodiment, the position information of the sound source in the sound field is determined, and based on the audio data information and at least one of the orientation change information, the position change information and the angle change information about the target, the attenuation degree of the sound in the sound source is determined through the preset processing algorithm. Based on the audio data information and the attenuation degree of the sound, the sound field is reconstructed through the preset processing algorithm, so that the user may experience that the sound field in the virtual environment changes with the change of his position, thereby improving the user's experience in the scene.

Figure 4:
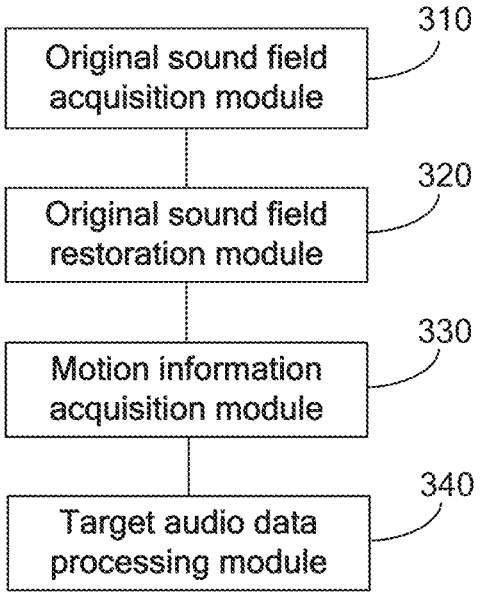
FIG. 4 is a block diagram showing an apparatus for processing audio data in a sound field according to an embodiment of the present disclosure.

FIG. 4 is a block diagram showing an apparatus for processing audio data in a sound field according to an embodiment of the present disclosure. The apparatus may be implemented by at least one of software and hardware, and is generally integrated into a playback device such as a sound box or a headset. As shown in FIG. 4, the apparatus includes an original sound field acquisition module 310, an original sound field restoration module 320, a motion information acquisition module 330 and a target audio data processing module 340.

The original sound field acquisition module 310 is configured to acquire audio data in a sound field.

The original sound field restoration module 320 is configured to process the audio data through a preset restoration algorithm so as to extract audio data information about the sound field carried by the audio data.

The motion information acquisition module 330 is configured to acquire motion information about a target.

The target audio data processing module 340 is configured to generate, through a preset processing algorithm, target-based sound field audio data based on the audio data information and the motion information about the target.

This embodiment provides an apparatus for processing audio data in the sound field. After the audio data in an original sound field is acquired, the sound field is restored, through the preset restoration algorithm, based on the audio data to obtain the audio data information about the original sound field. The motion information about the target is acquired, and target-based sound field audio data is obtained, through the preset processing algorithm, based on the audio data information and the motion information about the target. The sound field is reconstructed according to the real-time motion of the target so that the audio data in the sound field may change with the motion of the target. In the process of scene simulation, the auxiliary effect of the sound may be enhanced and "immersive" experience of the user in the current scene may be improved.

On the basis of the above embodiment, the audio data information about the sound field includes at least one of: position information, direction information, distance information and motion trajectory information about a sound source in the sound field.

On the basis of the above embodiment, the motion information includes at least one of: orientation change information, position change information and angle change information.

On the basis of the above embodiment, the target audio data processing module 340 includes: an attenuation degree determination unit configured to determine, through the preset processing algorithm, an attenuation degree of an audio signal in the sound field based on the audio data information and at least one of the orientation change information, the position change information and the angle change information about the target; and a sound field reconstruction unit configured to reconstruct, through the preset processing algorithm, the sound field based on the audio data information and the attenuation degree to obtain the target-based sound filed audio data.

On the basis of the above embodiment, the attenuation degree determination unit is configured to determine an initial distance between the target and the sound source; determine relative position information about the position of the target being moved relative to the sound source according to at least one of the orientation change information, the position change information and the angle change information of the target; and determine the attenuation degree of the audio signal according to the initial distance and the relative position information.

On the basis of the above embodiment, the sound field reconstruction unit is configured to adjust an amplitude of the audio signal according to the attenuation degree and take the audio signal adjusted as a target audio signal; and reconstruct, through the preset processing algorithm, the sound field based on the target audio signal to obtain the target-based sound filed audio data. The apparatus for processing the audio data in the sound field provided by this embodiment may execute the method for processing the audio data in the sound field provided by any embodiment described above, and has functional modules and beneficial effects corresponding to the method.

An embodiment of the present disclosure further provides a computer-readable storage medium for storing computer-executable instructions. The computer-executable instructions are used for executing the method for processing the audio data in the sound field described above.

Figure 5:
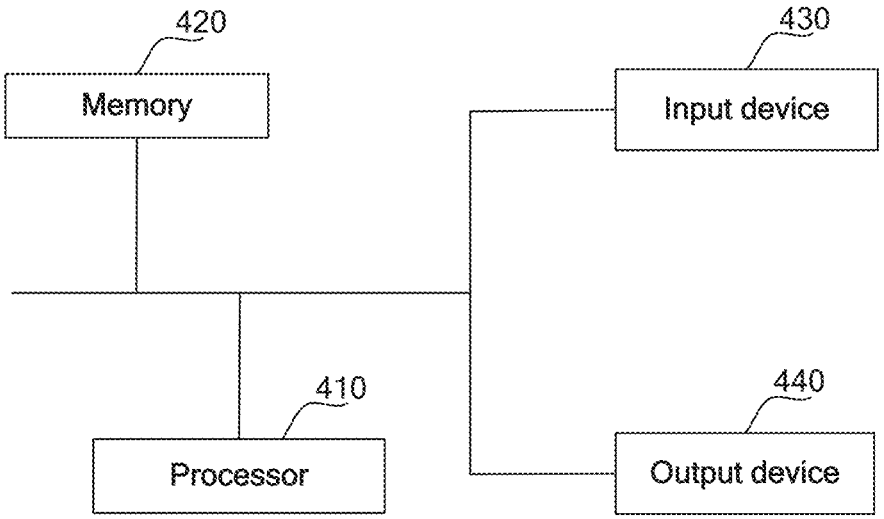
FIG. 5 is a schematic diagram showing a hardware structure of a terminal device according to an embodiment of the present disclosure.

FIG. 5 is a schematic diagram showing the hardware structure of a terminal device according to an embodiment of the present disclosure. As shown in FIG. 5, the terminal device includes: one or more processors 410 and a memory 420. Exemplarily, only one processor 410 is adopted in FIG. 5.

The terminal device may further include an input device 430 and an output device 440.

The processor 410, the memory 420, the input device 430 and the output device 440 in the terminal device may be connected via a bus or other means. In FIG. 5, the processor 410, the memory 420, the input device 430 and the output device 440 are connected via a bus.

The input device 430 is configured to receive digital or character information input, and the output device 440 may include a display device such as a display screen.

As a computer-readable storage medium, the memory 420 is configured to store software programs, computer-executable programs and modules. The processor 410 is configured to run the software programs, instructions and modules stored in the memory 420 to perform various function applications and data processing, that is, to implement any method in the above embodiments.

The memory 420 may include a program storage region and a data storage region. The program storage region is configured to store an operating system and an application program required by at least one function. The data storage region is configured to store data generated with use of a terminal device. In addition, the memory may include a volatile memory such as a random access memory (RAM), and may also include a nonvolatile memory, e.g., at least one disk memory, a flash memory or other non-transient solid-state memories.

The memory 420 may be a non-transient computer storage medium or a transient computer storage medium. The non-transient computer storage medium includes, for example, at least one disk memory, a flash memory or another nonvolatile solid-state memory. In some embodiments, the memory 420 optionally includes a memory which is remotely disposed relative to the processor 410, and the remote memory may be connected to the terminal device via a network. Examples of such a network may include the Internet, intranets, local area networks, mobile communication networks, and combinations thereof.

The input device 430 may be used for receiving digital or character information input and for generating key signal input related to user settings and function control of the terminal device. The output device 440 may include a display device such as a display screen.

All or part of the procedures in the methods of the above embodiments may be implemented by related hardware executed by computer programs, these programs may be stored in a non-transient computer-readable storage medium, and during the execution of these programs, the procedures in the above embodiments may be implemented. The non-transient computer-readable storage medium may be a magnetic disk, an optical disk, a read-only memory (ROM) or a random access memory (RAM).

INDUSTRIAL APPLICABILITY

In the method and apparatus for processing the audio data in the sound field provided by the present disclosure, the sound field is reconstructed according to the real-time motion of the target, so that the audio data in the sound field changes with the motion of the target. In the process of scene simulation, the auxiliary effect of the sound may be enhanced and "immersive" experience of the user in the current scene may be improved.

What is claimed is:

1. A method for processing audio data in a sound field, comprising:

acquiring the audio data in the sound field;

processing the audio data through a preset restoration algorithm to extract audio data information about the sound field carried by the audio data;

acquiring motion information about a target; and generating, through a preset processing algorithm, target-based sound field audio data based on the audio data information and the motion information about the target;

wherein the motion information comprises angle change information;

wherein the generating, through a preset processing algorithm, target-based sound field audio data based on the audio data information and the motion information about the target comprises:

determining, through the preset processing algorithm, an attenuation degree of intensity of an audio signal in the sound field based on the audio data information and the angle change information about the target; and reconstructing, through the preset processing algorithm, the sound field based on the audio data information and the attenuation degree to obtain the target-based sound filed audio data;

wherein the determining, through the preset processing algorithm, an attenuation degree of intensity of an audio signal in the sound field based on the audio data information and the angle change information about the target comprises:

determining an initial distance between the target and a sound source in the sound field;

determining relative position information about the position of the target being moved relative to the sound source based on the angle change information about the target; and determining the attenuation degree of the audio signal based on the initial distance and the relative position information;

wherein the reconstructing, through the preset processing algorithm, the sound field based on the audio data information and the attenuation degree to obtain the target-based sound filed audio data comprises:

adjusting an amplitude of the audio signal according to the attenuation degree, and using the audio signal being adjusted as a target audio signal; and reconstructing, through the preset processing algorithm, the sound field based on the target audio signal to obtain the target-based sound filed audio data.

2. The method according to claim 1, wherein the audio data information about the sound field comprises at least one of the following information about a sound source in the sound field: position information, direction information, distance information and motion trajectory information.

3. An apparatus for processing audio data in a sound field, comprising a processor and a storage device for storing computer executable instructions that when executed by the processor cause the processor to:

acquire the audio data in the sound field;

process the audio data through a preset restoration algorithm to extract audio data information about the sound field carried by the audio data;

acquire motion information about a target; and generate, through a preset processing algorithm, target-based sound field audio data based on the audio data information and the motion information about the target;

wherein the motion information comprises angle change information;

wherein the processor is further caused to determine, through the preset processing algorithm, an attenuation degree of intensity of an audio signal in the sound field based on the audio data information and the angle change information about the target; and reconstruct, through the preset processing algorithm, the sound field based on the audio data information and the attenuation degree to obtain the target-based sound filed audio data;

wherein the processor is further caused to:

determine an initial distance between the target and the sound source in the sound field;

determine relative position information about the position of the target being moved relative to the sound source according to the angle change information about the target; and determine the attenuation degree of the audio signal according to the initial distance and the relative position information;

wherein the processor is further caused to:

adjust an amplitude of the audio signal according to the attenuation degree, and use the audio signal being adjusted as a target audio signal; and reconstruct, through the preset processing algorithm, the sound field based on the target audio signal to obtain the target-based sound filed audio data.

4. The apparatus according to claim 3, wherein the audio data information about the sound field comprises at least one of the following information about a sound source in the sound field: position information, direction information, distance information and motion trajectory information.

5. A non-transitory computer-readable storage medium storing computer-executable instructions, wherein the computer-executable instructions are used for executing the method according to claim 1.

* * * * *